US006272880B1

(12) United States Patent
Miki et al.

(10) Patent No.: US 6,272,880 B1
(45) Date of Patent: Aug. 14, 2001

(54) AIR CONDITIONER

(75) Inventors: Hiroshi Miki; Yasushi Fujiwara; Satoru Yoshimitsu, all of Osaka; Akihito Matsumoto, Shiga, all of (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/295,605

(22) Filed: Apr. 22, 1999

(51) Int. Cl.[7] ..... F25D 17/04

(52) U.S. Cl. ..... 62/404; 62/415; 62/416; 62/179; 62/180; 62/426; 62/525

(58) Field of Search ..... 62/415, 404, 416, 62/179, 180, 426, 525

(56) References Cited

U.S. PATENT DOCUMENTS

| | | | | |
|---|---|---|---|---|
| 3,389,575 | * | 6/1968 | Frohbieter | 62/415 |
| 4,655,278 | * | 4/1987 | Seguin | 165/2 |
| 5,313,803 | * | 5/1994 | Detzer | 62/89 |
| 5,590,540 | * | 1/1997 | Ikeda et al. | 62/180 |
| 5,598,715 | * | 2/1997 | Edmisten | 62/176.6 |
| 5,642,856 | * | 7/1997 | Samukama et al. | 236/49.3 |
| 6,000,232 | * | 12/1999 | Witten-hannah et al. | 62/89 |

FOREIGN PATENT DOCUMENTS

| | | |
|---|---|---|
| 4-270851 | 9/1992 | (JP) . |
| 4-270852 | 9/1992 | (JP) . |
| 4-270853 | 9/1992 | (JP) . |

* cited by examiner

*Primary Examiner*—William Doerrler
*Assistant Examiner*—Mark S. Shulman
(74) *Attorney, Agent, or Firm*—Nixon Peabody LLP; Donald R. Studebaker

(57) ABSTRACT

A heat-source-side space and two heat-use-side spaces are formed in a casing. A heat-source-side heat exchanger is contained in the heat-source-side space, and heat-use-side heat exchangers are individually contained in the heat-use-side spaces. The casing is formed with a plurality of suction ports for room air and a plurality of delivery ports for conditioned air. The suction ports and the delivery ports are individually connected to ducts communicating with rooms. The heat-source-side heat exchanger and the plurality of heat-use-side heat exchangers constitute refrigerant circuitry.

20 Claims, 5 Drawing Sheets

10
1B
20
21
22
23
24
25
26
40
41
42
47
49
71
72
2a
2b
2c
F1
F2

1B
41
62
49
1M
48
F1
4a
63
60
6a
6b
61
40
43
6M
63
48
45
4b
6N
44
67
66
F2
F2
45
1N
64
63
6N
42
65
65
64
63
4b
1N
46
11
11
46

AIR CONDITIONER

FIELD OF THE INVENTION

This invention relates to an air conditioner and particularly relates to an air conditioner including a plurality of heat-use-side heat exchangers.

DESCRIPTION OF THE PRIOR ART

There is a conventional type air conditioner having an heat-use-side unit as an indoor unit and a duct connected to the heat-use-side unit and communicated with rooms (See, for example, Japanese Patent Application Laid-Open Gazette No.4-270851).

Conditioned air produced in the heat-use-side unit is delivered from the heat-use-side unit to the rooms through the duct. The rooms are air-conditioned by the conditioned air.

Another example of conventional air conditioners is of a rooftop type. In the rooftop type air conditioner, a heat-source-side unit and a heat-use-side unit are contained in a single casing thereby forming a main body of the air conditioner. The main body is installed on a rooftop of a building. A duct is extended from the main body to the rooms in the building. Conditioned air produced in the main body is delivered to the rooms through the duct.

As is understood from the foregoing, in the above conventional air conditioners, the duct connected to the heat-use-side unit or the main body is branched into plural branch ducts, and the plural branch ducts are communicated individually with a plurality of air conditioning zones such as rooms.

In other words, conditioned air produced in the single heat-use-side unit or the main body of the air conditioner is delivered to the plural air conditioning zones. Therefore, the conditioned air is at a uniform temperature. This arises a problem that individual temperature control on each of the air conditioning zones is very much difficult.

Specifically, there is a case where the air conditioning zones have different heat loads. In this case, the air conditioning zones cannot be supplied individually with conditioned air streams at temperatures in response to the heat loads thereof. This arises a problem of deteriorating comfortableness.

The present invention has been made in view of the above problems and therefore has its object of achieving improvement in comfortableness by enabling the supply of conditioned air streams in response to different heat loads.

SUMMARY OF THE INVENTION

In the present invention, a single casing is divided into a plurality of heat-use-side spaces and heat-use-side heat exchangers are contained in the plurality of heat-use-side spaces, respectively.

More specifically, an air conditioner of the present invention includes a casing in which a plurality of heat-use-side spaces are formed. In the heat-use-side spaces of the casing, heat-use-side heat exchangers are contained respectively. Further, in the casing, a plurality of suction ports for air open to the respective heat-use-side spaces and a plurality of delivery ports for conditioned air open to the respective heat-use-side spaces are formed. The plurality of heat-use-side heat exchangers are connected to a heat-source-side heat exchanger to form refrigerant circuitry.

Alternatively, the casing containing the heat-source-side heat exchanger may be formed integrally with the casing containing the heat-use-side heat exchangers to constitute a single casing.

At least one of the suction ports and the delivery ports may be connected to a duct communicating with a room.

Another air conditioner of the present invention includes a casing in which a heat-source-side space and a plurality of heat-use-side spaces are formed. In the heat-source-side space of the casing, a heat-source-side heat exchanger is contained. In the heat-use-side spaces of the casing, heat-use-side heat exchangers are contained respectively. Further, in the casing, a plurality of suction ports for air open to the respective heat-use-side spaces and a plurality of delivery ports for conditioned air open to the respective heat-use-side spaces are formed. At least one of the suction ports and the delivery ports is connected to a duct communicating with a room. In addition, the heat-source-side heat exchanger is connected to the plurality of heat-use-side heat exchangers to form refrigerant circuitry.

The casing may be installed on a rooftop.

Liquid lines in the refrigerant circuitry preferably include expansion mechanisms individually provided between a branch part of refrigerant piping and respective ones of the heat-use-side heat exchangers.

In the casing, an open-air intake may be formed for taking open air in at least one of the heat-use-side spaces.

Heat-recycling heat exchangers for applying heat to dehumidified air may be contained individually in the heat-use-side spaces and may be connected to the refrigerant circuitry.

The refrigerant circuitry may be provided with connection ports for connecting an additional heat exchanger thereto.

Heat-use-side units each containing one of the heat use-side heat exchangers may be contained in the heat-use-side spaces, respectively, and may be formed in the same arrangements of components in the respective heat-use-side spaces.

Heat-use-side units each containing one of the heat-use-side heat exchangers may be contained in the heat-useside spaces, respectively, and the heat-use-side unit in the heat-use-side space of one type and the heat-use-side unit in the heat-use-side space of the other type may be formed in symmetric arrangements of components.

At least either of the suction ports and the delivery ports may be formed at the same positions with respect to the heat-use-side spaces.

At least either of the suction ports and the delivery ports may be formed so that the port open to the heat-use-side space of one type and the port open to the heat-use-side space of the other type are at symmetric positions.

Ports of at least one type out of the suction ports, the delivery ports and the open-air intakes may be formed at the same positions with respect to the heat-use-side spaces.

Ports of at least one type out of the suction ports, the delivery ports and the open-air intakes may be formed so that the port open to the heat-use-side space of one type and the port open to the heat-use-side space of the other type are at symmetric positions.

In the present invention, during a circulation of refrigerant through the refrigerant circuitry, the refrigerant condenses in the heat-source-side heat exchanger, flows into the heat-use-side heat exchangers and evaporates therein. This circulation of refrigerant is repeated. On the other hand, individual air streams flowing into the heat-use-side spaces through the suction ports are heat-exchanged into conditioned air streams by the heat-use-side heat exchangers, respectively. The conditioned air streams are blown off from the delivery ports, respectively.

The conditioned air streams are delivered to the rooms through for example the ducts, respectively. This leads to generation of a plurality of conditioned air streams adjusted individually to different temperatures in response to different heat loads in the respective rooms. The conditioned air streams are delivered individually to the rooms.

In each of the heat-use-side heat exchangers, individual control of each refrigerant flow is exercised in response to the heat load by using, for example, the expansion mechanism.

Open air may be taken in each of the heat-use-side spaces through the open-air intake. In this case, fresh air is supplied to the room.

If the heat-recycling heat exchanger is provided in each of the heat-use-side spaces, air is cooled and dehumidified in each of the heat-use-side heat exchangers. Thereafter, the dehumidified air is heated by the heat-recycling heat exchanger and is then delivered to the room. As a result, such humidity-adjusted conditioned air is delivered to the room.

The refrigerant circuitry is connected to for example various kinds of additional heat exchangers through connection ports. As a result, an additional function such as air conditioning of a small room is imparted.

According to the present invention, since the plurality of heat-use-side spaces are formed in the casing and the heat-use-side heat exchangers are disposed individually in the heat-use-side spaces, air conditioning in response to different heat loads can be performed.

Specifically, conditioned air streams having different temperatures in response to different heat loads in the respective rooms can be produced. And, many kinds of temperature-adjusted conditioned air streams can be delivered to the rooms, respectively. This achieves improved comfortableness in the respective rooms.

If the expansion mechanisms are provided in correspondence with the respective heat-use-side heat exchangers, individual control of each refrigerant flow can be exercised in response to the heat load.

If the open-air intake is provided, fresh air can be surely taken in the room. This ensures that the room is ventilated.

If the heat-recycling heat exchanger is provided, air dehumidified in the heat-use-side heat exchanger can be heated again in the heat-recycling heat exchanger. Accordingly, humidity-adjusted conditioned air can be delivered to the room. This enables control of not only the room temperature but also the room humidity, thereby achieving further improved comfortableness.

If the refrigerant circuitry is provided with the connection ports, various kinds of additional heat exchangers can be connected to the refrigerant circuitry. This achieves fostered versatility and increased installation flexibility.

If the plurality of heat-use-side units are in the same component arrangements or the delivery ports and the like for the plurality of heat-use-side spaces are formed at the same positions, specifications in manufacturing can be unified.

This facilitates manufacturing process, increases product accuracy and reduces manufacturing costs.

If the suction ports and the like for the plurality of heat-use-side spaces are formed in symmetric positions, the port type such as a suction port can be readily discriminated from the other port type. This prevents misconnection of a suction duct or the like. Further, in this case, the weight can be evenly distributed. This weight distribution can stabilize the position of the air conditioner after installed.

DESCRIPTION OF PREFERRED EMBODIMENTS

<Embodiment 1>

Below, a detailed description will be given to Embodiment 1 of the present invention with reference to the drawings.

Figure 1:
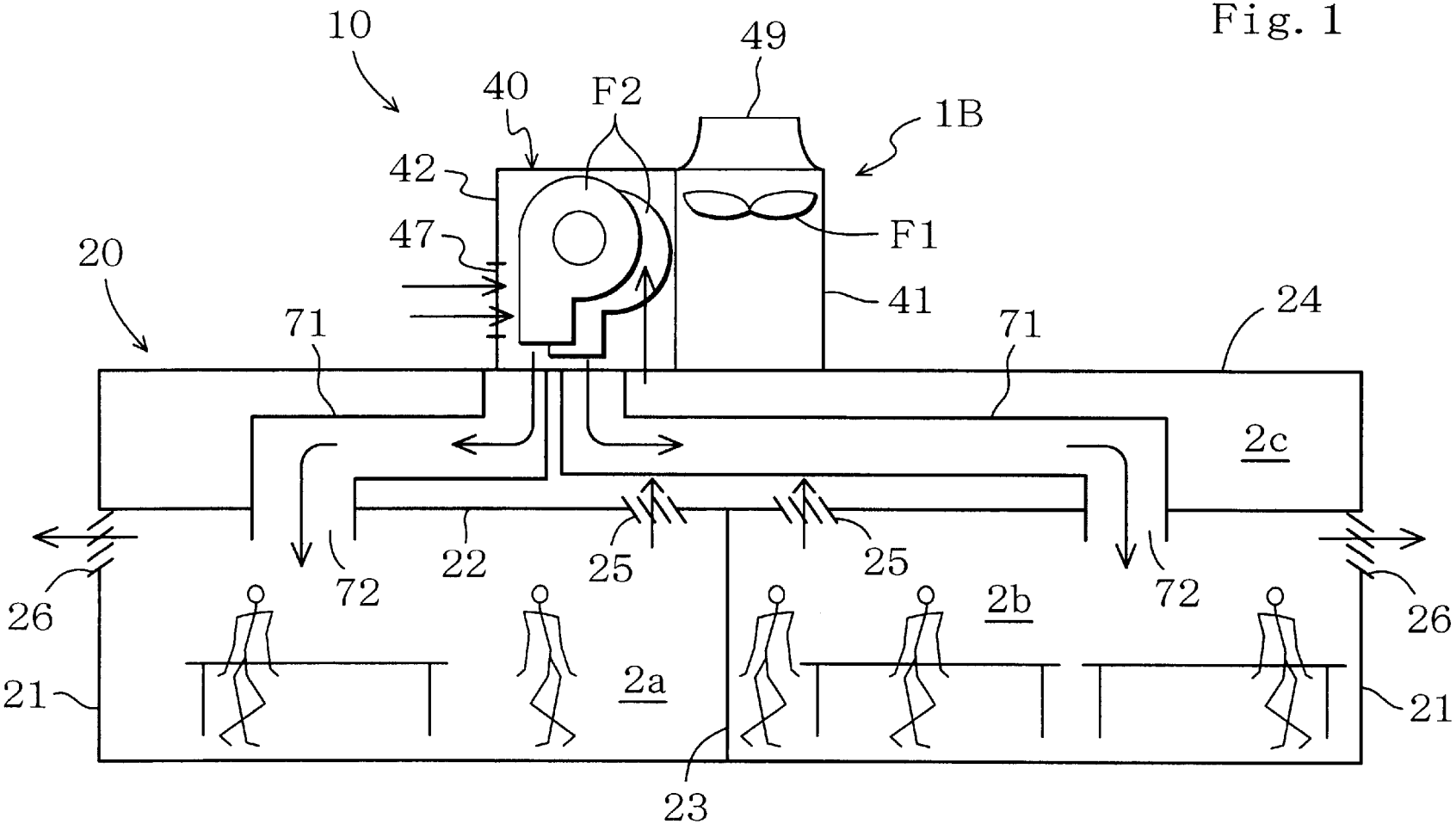
FIG. 1 is a schematic view illustrating an entire building in which an air conditioner according to Embodiment 1 of the present invention is installed.

As shown in FIG. 1, an air conditioner (10) of the present embodiment is a rooftop type air conditioner. An air conditioner body (1B) as a main body of the air conditioner (10) is installed on a roof of a building (20).

An example of the building (20) is a one-floor building. The building (20) includes, for example, two rooms defined by side walls (21), a ceiling (22) and a partition (23). One of the two rooms is formed into a first air conditioning zone (2*a*), while the other room is formed into a second air conditioning zone (2*b*).

The building (20) has a rooftop (24) provided a certain distance above the ceiling (22). A space between the rooftop (24) and the ceiling (22) constitutes a ceiling space (2*c*).

Figure 2:
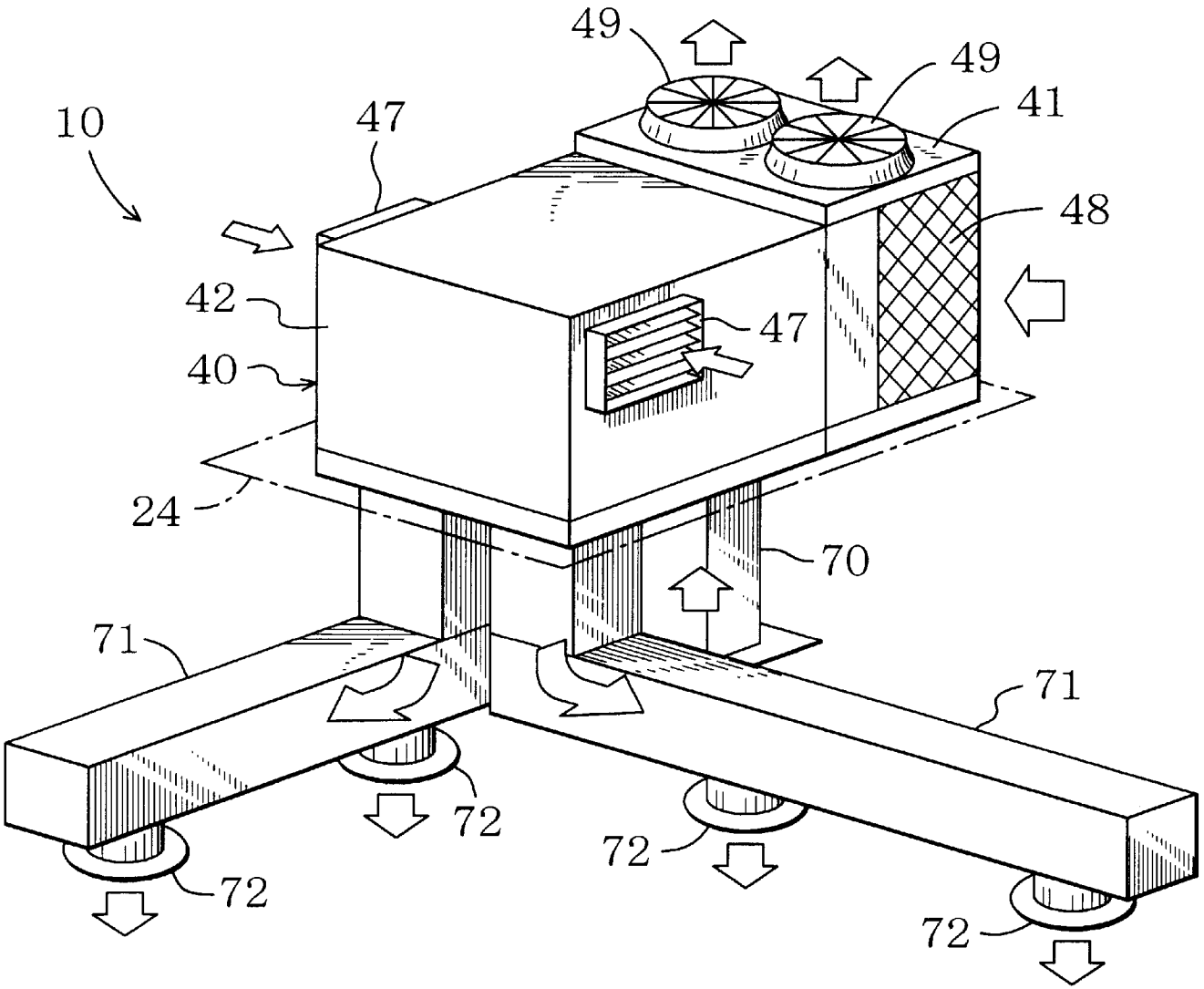
FIG. 2 is a perspective view showing the air conditioner of Embodiment 1.
Figure 3:
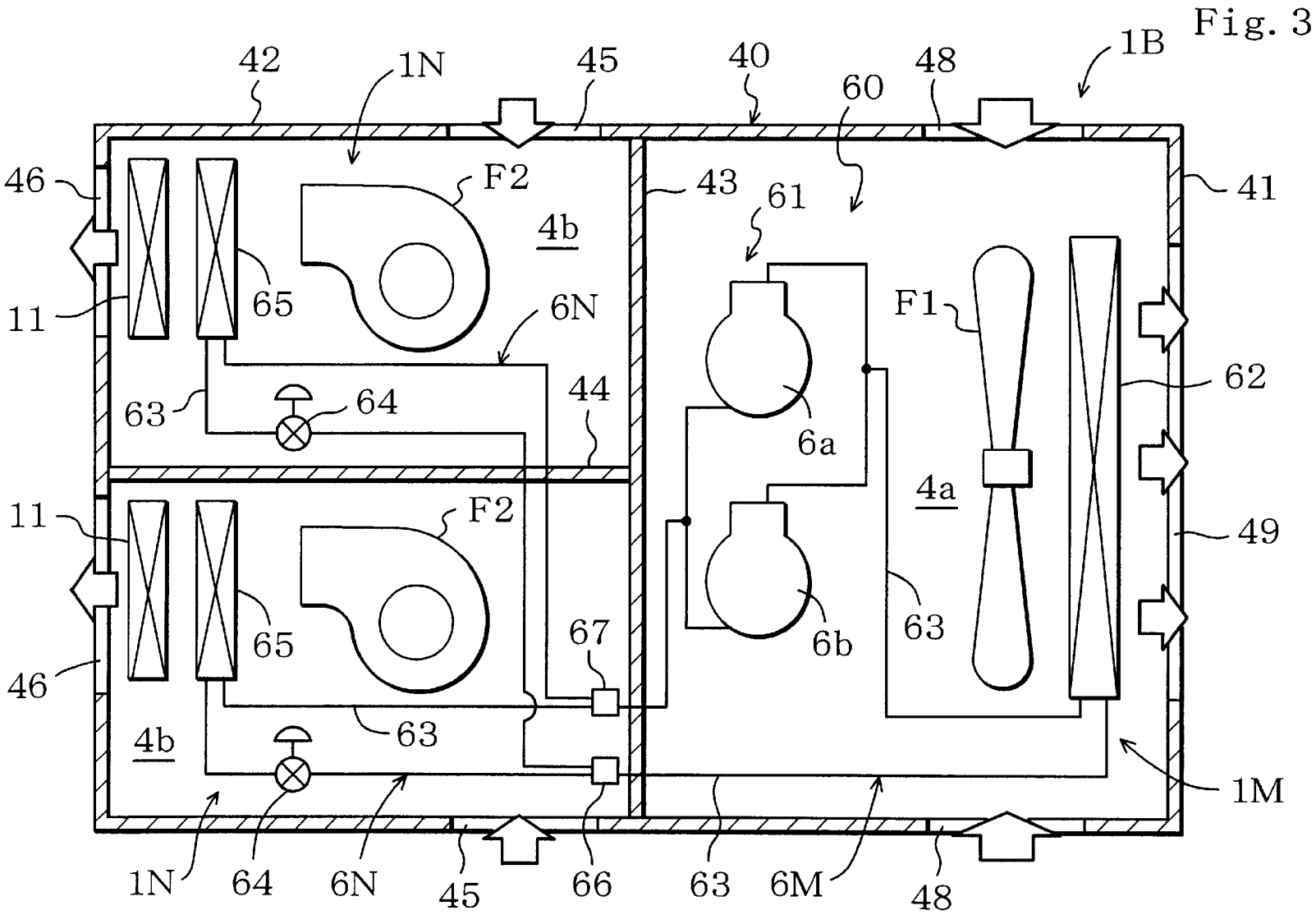
FIG. 3 is a refrigerant circuit diagram showing refrigerant circuitry of the air conditioner of Embodiment 1.

The air conditioner body (1B) produces conditioned air for air-conditioning the first air conditioning zone (2*a*) and the second air conditioning zone (2*b*). As shown in FIGS. 2 and 3, the air conditioner body (1B) is provided with a body casing (40), and one heat-source-side unit (1M) and two heat-use-side units (1N, 1N) all of which are contained in the body casing (40). A unit of refrigerant circuitry (60) is formed of the heat-source-side unit (1M) and the two heat-use-side units (1N, 1N).

The refrigerant circuitry (60) is constituted of a vapor compression type refrigerating cycle in which refrigerant circulates for space-cooling operation. The refrigerant circuitry (60) includes a heat-source-side circuit (6M) and two heat-use-side circuits (6N, 6N). The heat-source-side circuit (6M) is provided in the heat-source-side unit (1M). Further, the heat-source-side circuit (6M) is configured such that a compression mechanism (61) and a heat-source-side heat exchanger (62) are series-connected through a piece of refrigerant piping (63).

The compression mechanism (61) is configured such that two compressors (6*a*, 6*b*) are connected in parallel. Out of the two compressors (6*a*, 6*b*), one compressor (6*a*) is variably adjusted in capacity by inverter control.

In addition, the heat-source-side heat exchanger (62) is provided with a single heat-source-side fan (F1).

The heat-use-side circuits (6N, 6N) are provided individually in the heat-use-side units (1N, 1N). Each of the heat-use-side circuits (6N) is configured such that a motor-operated expansion valve (64) and a heat-use-side heat exchanger (65) are series-connected through another piece of the refrigerant piping (63).

In addition, the heat-use-side heat exchangers (65, 65) are provided with heat-use-side fans (F2, F2), respectively.

The two heat-use-side circuits (6N, 6N) are connected to the heat-source-side circuit (6M) through a branch part (66) for branching a flow of refrigerant and a collection part (67) for collecting two flows of refrigerant. Namely, the two heat-use-side circuits (6N, 6N) are connected in parallel with each other.

The motor-operated expansion valves (64) are provided in a one-to-one correspondence with the heat-use-side heat exchangers (65). The motor-operated expansion valve (64) is disposed in a liquid line located between the branch part (66) and the heat-use-side heat exchanger (65). The motor-operated expansion valve (64) constitutes an expansion mechanism adjustable in opening and the opening thereof is controlled in accordance with the change of heat load.

The heat-use-side units (1N, 1N) are provided with space-heating heat exchangers (11, 11), respectively, in addition to the heat-use-side circuits (6N, 6N). The space-heating heat exchanger (11) is configured so as to produce conditioned air through the application of heat to room air by for example a gas furnace. The space-heating heat exchanger (11) is disposed on the downstream side of air from the heat-use-side heat exchanger (65) of the refrigerant circuitry (60). In other words, the heat-use-side heat exchanger (65) and the space-heating heat exchanger (11) are arranged such that air discharged from the heat-use-side fan (F2) first flows through the heat-use-side heat exchanger (65) and then flows through the space-heating heat exchanger (11).

The body casing (40) is fixedly secured on the rooftop (24) of the building (20). The body casing (40) is formed into an almost rectangle. The body casing (40) includes a first parting plate (43) for dividing the inner space into right and left spaces and a second parting plate (44) for dividing the inner space into upper and lower spaces, when viewed in FIG. 3.

As shown in FIG. 3, a heat-source-side casing (41) is formed of the right half of the body casing (40) and the first parting plate (43), while a heat-use-side casing (42) is formed of the left half of the body casing (40) and the first parting plate (43). In other words, the heat-source-side casing (41) and the heat-use-side casing (42) are integrally formed into the body casing (40).

The inner space of the heat-source-side casing (41) constitutes a heat-source-side space (4*a*). The inner space of the heat-use-side casing (42) is formed into two heat-use-side spaces (4*b*, 4*b*) divided by the second parting plate (44). The heat-source-side unit (1M) is contained in the heatsource-side space (4*a*), while the heat-use-side units (1N, 1N) are contained individually in the heat-use-side spaces (4*b*, 4*b*).

The heat-use-side casing (42) is formed with two suction ports (45, 45), two delivery ports (46, 46) and two open-air intakes (47, 47). The individual suction ports (45, 45), the individual delivery ports (46, 46) and the individual open-air intakes (47, 47) are open to the respective heat-use-side spaces (4*b*, 4*b*). It is to be noted that in FIG. 3, the suction ports (45, 45) and the delivery ports (46, 46) are illustrated in the side surfaces for ease of description.

The two heat-use-side units (1N, 1N) in the heat-use-side casing (42) are placed in the same arrangements of their components. Specifically, as shown in FIG. 3, the compressors (6*a*, 6*b*), the heat-use-side heat exchangers (65, 65) and the space-heating heat exchangers (11, 11) in the two heat-use-side units (1N, 1N) are placed at the same positions in the respective heat-use-side spaces (4*b*, 4*b*).

Further, the two delivery ports (46, 46) are formed at the same positions. For example, the two delivery ports (46, 46) are provided at the same upper positions on the same sides of the respective heat-use-side spaces (4*b*, 4*b*) when viewed in FIG. 3.

The two suction ports (45, 45) are formed in the symmetric positions to each other and the two open-air intakes (47, 47) are also formed in the symmetric positions to each other. For example, the two suction ports (45, 45) are formed in positions vertically symmetric with respect to the second parting plate (44) when viewed in FIG. 3.

For example, the two open-air intakes (47, 47) are formed in positions vertically symmetric with respect to the second parting plate (44) when viewed in FIG. 2.

The suction ports (45, 45) are formed in the bottom surface of the heat-use-side casing (42) when viewed in FIG. 2. The suction ports (45, 45) are connected individually to suction ducts (70, 70). The suction duct (70) communicates with the ceiling space (2*c*).

The ceiling (22) of the building (20) is formed with return ports (25, 25). The return ports (25, 25) communicate the first air conditioning zone (2*a*) and the second air conditioning zone (2*b*) with the ceiling space (2*c*) so that the ceiling space (2*c*) constitutes a return passage.

Accordingly, room air in the first and second air conditioning zones (2*a*, 2*b*) flows into the heat-use-side spaces (4*b*, 4*b*) through the ceiling space (2*c*).

The delivery ports (46, 46) are formed in the bottom surface of the heat-use-side casing (42) when viewed in FIG. 2. The delivery ports (46, 46) are connected individually to delivery ducts (71, 71). The delivery ducts (71, 71) pass through the ceiling space (2*c*) and the ceiling (22) and extend individually to the first air conditioning zone (2*a*) and the second air conditioning zone (2*b*). One ends of the delivery ducts (71, 71) are formed into air supply openings (72, 72), respectively. The air supply openings (72, 72) are individually open to the first air conditioning zone (2*a*) and the second air conditioning zone (2*b*).

Namely, one of the heat-use-side spaces (4*b*, 4*b*) communicates with the first air conditioning zone (2*a*) through the delivery duct (71), and the other heat-use-side space (4*b*) communicates with the second air conditioning zone (2*b*) through the other delivery duct (71). As a result, conditioned air produced by the one heat-use-side unit (1N) is delivered to the first air conditioning zone (2*a*), while conditioned air produced by the other heat-use-side unit (1N) is delivered to the second air conditioning zone (2*b*).

As shown in FIG. 2, the open-air intakes (47, 47) are formed individually in both side surfaces of the heat-use-side casing (42). The two open-air intakes (47, 47) are adapted to introduce outdoor air into the respective heat-use-side spaces (4*b*, 4*b*).

On the other hand, the heat-source-side casing (41) is formed with suction ports (48) through which outdoor air for heat exchange with the heat-source-side heat exchanger (62) is sucked, and discharge ports (49) through which outdoor air heat-exchanged with the heat-source-side heat exchanger (62) is discharged. It is to be noted that in FIG. 3, the discharge ports (49) are illustrated in the side surfaces for ease of description.

Further, the side wall (21) of the building (20) is formed with a discharge opening (26) for discharging room air to the outdoors.

Next, a description will be given to air conditioning operations of the above-mentioned air conditioner (10).

In a space-cooling operation, the two compressors (6*a*, 6*b*) are first driven. Refrigerant discharged from both the compressors (6*a*, 6*b*) is heat-exchanged with outdoor air by the heat-source-side heat exchanger (62) to condense therein. The condensed refrigerant in a liquid state is divided into two flows by the branch part (66) and the two flows of refrigerant individually pass through the heat-use-side circuits (6N, 6N). Then, each flow of the liquid refrigerant is reduced in pressure by the motor-operated expansion valve (64) and flows into the corresponding heat-use-side heat exchanger (65). In the heat-use-side heat exchanger (65), the liquid refrigerant is heat-exchanged with room air to evaporate. The evaporated refrigerant in a gas state returns to the compressors (6*a*, 6*b*). This circulation of refrigerant is repeated.

When the individual heat-use-side fans (F2, F2) are driven, room air in the air conditioning zones (2*a*, 2*b*) is sucked. The room air flows into the ceiling space (2*c*) through the return ports (25, 25) and then flows from the suction duct (70) into the heat-use-side spaces (4*b*, 4*b*). Thereafter, two streams of the room air individually pass through the heat-use-side fans (F2, F2) and are individually cooled by the heat-use-side heat exchangers (65, 65), thereby forming two streams of conditioned air.

The two streams of conditioned air individually pass through the delivery ducts (71, 71) and are individually delivered to the air conditioning zones (2*a*, 2*b*) through the air supply openings (72, 72). The two streams of conditioned air individually air-condition the air conditioning zones (2*a*, 2*b*).

Further, outdoor air flows into the heat-use-side spaces (4*b*, 4*b*) through the open-air intakes (47, 47). The outdoor air is turned into conditioned air and then delivered to the air conditioning zones (2*a*, 2*b*). Namely, so-called fresh air is delivered to the first air conditioning zone (2*a*) and the second air conditioning zone (2*b*). On the other hand, room air in the air conditioning zones (2*a*, 2*b*) is partly discharged from the discharge openings (26, 26).

In a space-heating operation, the drive of the refrigerant circuitry (60) is stopped, while the heat-use-side fans (F2, F2) are driven. In addition, the space-heating heat exchangers (11, 11) are driven. As a result, air flows as in the space-cooling operation. specifically, room air in the air conditioning zones (2*a*, 2*b*) flows through the ceiling space (2*c*) and then flows into the heat-use-side spaces (4*b*, 4*b*). Thereafter, two streams of the room air individually pass through the heat-use-side fans (F2, F2) and are individually heated by the space-heating heat exchangers (11, 11), thereby forming two streams of conditioned air.

The two streams of conditioned air individually pass through the delivery ducts (71, 71) and are individually delivered to the air conditioning zones (2*a*, 2*b*) through the air supply openings (72, 72). The two streams of conditioned air individually air-condition the air conditioning zones (2*a*, 2*b*).

During each of the above-mentioned operations, there is a case where the heat load of the second air conditioning zone (2*b*) is dropped. In such a case, during the space-cooling operation, the opening of the motor-operated expansion valve (64) of the heat-use-side unit (1N) communicating with the second air conditioning zone (2*b*) is decreased. This adjustment of the opening lowers cooling capability. During the space-heating operation, the capability of the space-heating heat exchanger (11) is lowered.

On the other hand, there is also a case where the heat load of the first air conditioning zone (2*a*) is dropped. In this case, during the space-cooling operation, the opening of the motor-operated expansion valve (64) of the heat-use-side unit (1N) communicating with the first air conditioning zone (2*a*) is decreased. This adjustment of the opening lowers cooling capability. During the space-heating operation, the capability of the space-heating heat exchanger (11) is lowered.

As a result, individual air conditioning is made in response to respective heat loads of the first and second air conditioning zones (2*a*, 2*b*). It is to be noted that the motor-operated expansion valve (64) may be fully closed so as to perform an air supply only.

As describes so far, in the present embodiment, two heat-use-side spaces (4*b*, 4*b*) are formed in the body casing (40) and the heat-use-side heat exchanger (65) is disposed in each of the heat-use-side spaces (4*b*, 4*b*). Accordingly, individual air conditioning can be made in response to respective heat loads of the air conditioning zones (2*a*, 2*b*).

Namely, streams of conditioned air having different temperatures can be produced in response to different heat loads of the air conditioning zones (2*a*, 2*b*). This two kinds of temperature-adjusted conditioned air can be delivered to the air conditioning zones (2*a*, 2*b*), respectively. This achieves improved comfortableness in the respective air conditioning zones (2*a*, 2*b*).

Further, since the motor-operated expansion valves (64, 64) are provided in a one-to-one correspondence with the heat-source-side heat exchangers (65, 65), individual control of each refrigerant flow can be exercised in response to the heat load.

Furthermore, since the open-air intakes (47, 47) are provided, fresh air can be surely taken in the rooms. This ensures that each of the air conditioning zones (2*a*, 2*b*) is ventilated.

Furthermore, since the two heat-use-side units (1N, 1N) have the same arrangements of components, specifications in manufacturing can be unified. In addition, since the delivery ports (46, 46) of the two heat-use-side spaces (4*b*, 4*b*) are formed at the same positions, specifications in manufacturing can be unified.

This facilitates manufacturing process, increases product accuracy and reduces manufacturing costs.

Further, since the suction ports (45, 45) and the open-air intakes (47, 47) for the two heat-use-side spaces (4*b*, 4*b*) are formed in symmetric positions, the port type such as the suction port (45) can be readily discriminated from the other port type. This prevents misconnection of the suction duct (70) or the like. In addition, in this case, the weight can be evenly distributed. This weight distribution can stabilize the position of the air conditioner after installed.

Modification of Embodiment 1

The above-mentioned space-heating heat exchanger (11) is a heat exchanger for a space-heating operation only. However, the space-heating heat exchanger (11) may be used as a heat exchanger for a dehumidifying operation, or may be used as a heat exchanger for both space-heating and dehumidifying operations.

Specifically, in a dehumidifying operation, when the refrigerant circuitry (60) is driven, refrigerant is cooled in the heat-use-side heat exchanger (65) to dehumidify room air and outdoor air. Thereafter, the cooled air is heated again in the space-heating heat exchanger (11). This heating of air enables conditioned air having substantially the same temperature as room temperature to be delivered to the respective air conditioning zones (2*a*, 2*b*).

As a result, not only room temperature but also room humidity can be controlled. Accordingly, further improved comfortableness can be achieved.

<Embodiment 2>

Next, a detailed description will be given to Embodiment 2 of the present invention with reference to the drawing.

Figure 4:
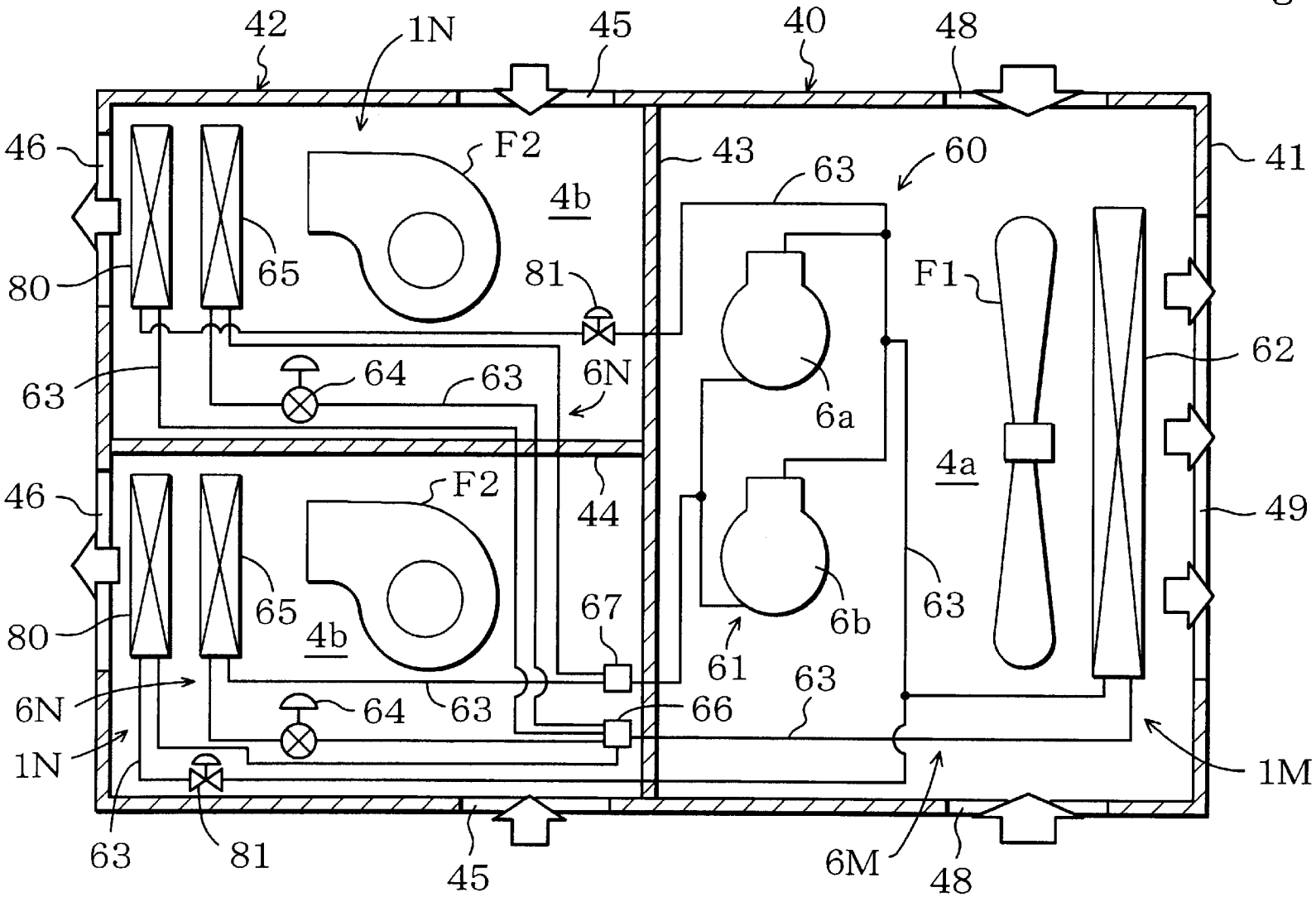
FIG. 4 is a refrigerant circuit diagram showing refrigerant circuitry of an air conditioner according to Embodiment 2 of the present invention.

As shown in FIG. 4, in the present embodiment, heat-recycling heat exchangers (80, 80) are provided instead of the space-heating heat exchangers (11, 11) of Embodiment 1.

The heat-recycling heat exchangers (80, 80) are individually provided in the heat-use-side units (1N, 1N) and are individually disposed in the heat-use-side spaces (4*b*, 4*b*). One end of the heat-recycling heat exchanger (80) is connected to the discharge side of the compression mechanism (61), with a shut-off valve (81) interposed therebetween, through a piece of the refrigerant piping (63). The other end of the heat-recycling heat exchanger (80) is connected to the branch part (66) through another piece of the refrigerant piping (63).

With this arrangement, in carrying out a dehumidifying operation, the shut-off valves (81, 81) are opened and the compression mechanism (61) is driven. Refrigerant discharged from the compression mechanism (61) is delivered to not only the heat-source-side heat exchanger (62) but also the heat-recycling heat exchangers (80, 80). The flows of refrigerant condensed in the heat-source-side heat exchanger (62) and the heat-recycling heat exchangers (80, 80) flow into the heat-use-side heat exchangers (65, 65), and circulation of refrigerant is repeated as in Embodiment 1.

On the other hand, two streams of room air and the like discharged from the heat-use-side fans (F2, F2) are individually cooled and dehumidified in the heat-use-side heat exchangers (65, 65). Thereafter, the two streams of cooled air are individually heated again in the heat-recycling heat exchangers (80, 80) so as to be delivered to the respective air conditioning zones (2*a*, 2*b*) as conditioned air streams having substantially the same temperature as room temperature.

As a result, not only room temperature but also room humidity can be controlled, thereby achieving further improved comfortableness.

In the present embodiment, since the heat-use-side units (1N, 1N) carry out no space-heating operation, space heating can be made by other heating equipment, if necessary.

<Embodiment 3>

Next, a detailed description will be given to Embodiment 3 of the present invention with reference to the drawing.

Figure 5:
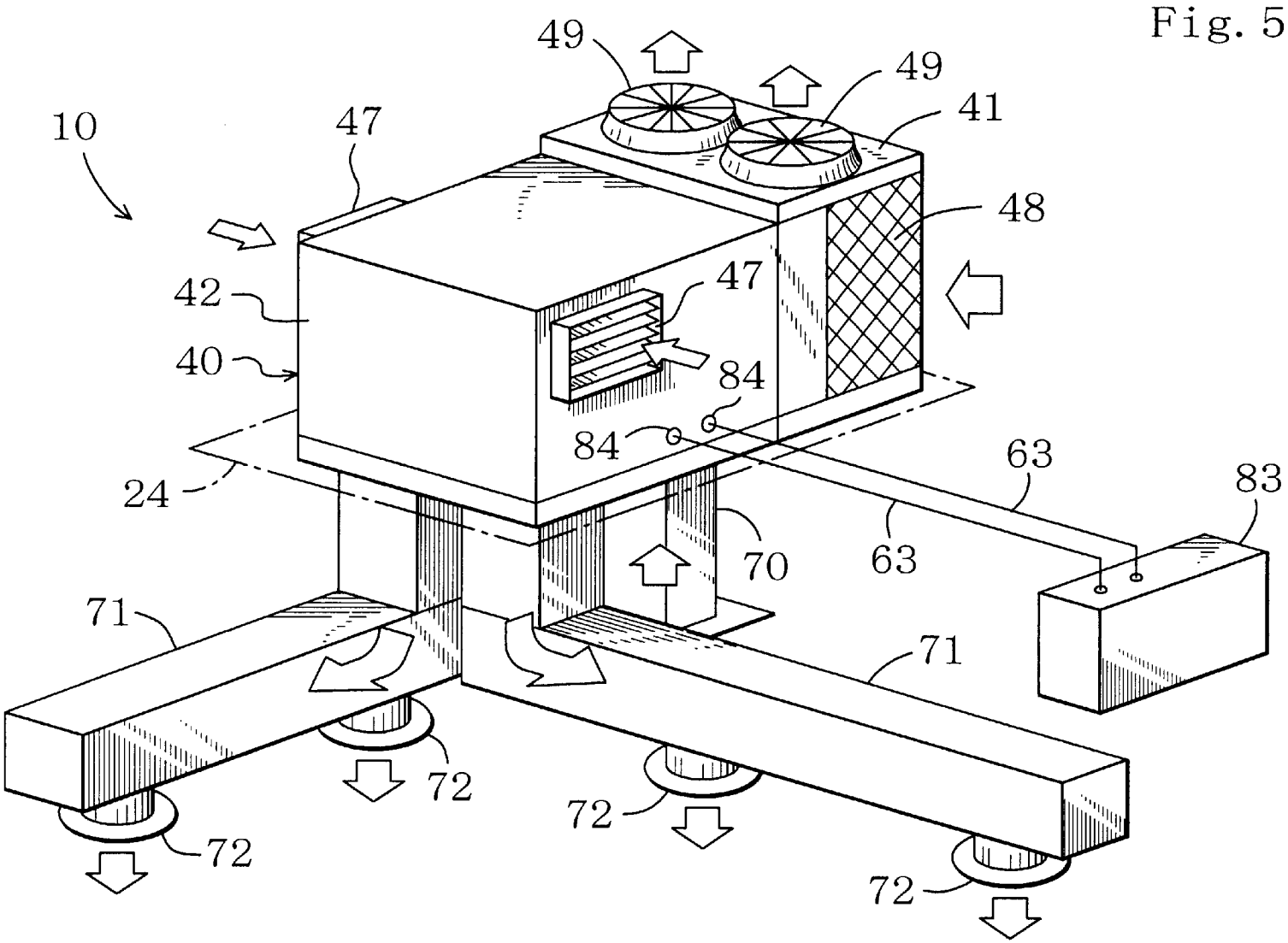
FIG. 5 is a perspective view showing an air conditioner according to Embodiment 3 of the present invention.

As shown in FIG. 5, in the present embodiment, an additional heat exchanger (83) is provided in the refrigerant circuitry (60) of Embodiment 1.

The additional heat exchanger (83) is formed by, for example, a heat exchanger for a kitchen or a heat exchanger in an open-air treatment unit. The refrigerant circuitry (60) is provided with two connection ports (84, 84). The additional heat exchanger (83) is connected to the connection ports (83, 83) through pieces of the refrigerant piping (63, 63).

In the case where the additional heat exchanger (83) is a heat exchanger for a kitchen, refrigerant is heat-exchanged with room air in the kitchen to cool the kitchen. On the other hand, in the case where the additional heat exchanger (83) is a heat exchanger in an open-air treatment unit, the open-air treatment unit is installed in a ventilating opening. The open-air treatment unit heats or cools open air taken through the ventilating opening and then supplies it to the room.

According to the present embodiment, since the refrigerant circuitry (60) is provided with the connection ports (84, 84), various types of additional heat exchangers (83) can be connected to the refrigerant circuitry (60). This achieves fostered versatility and increased installation flexibility.

The present invention can be carried out in various other forms without deviating from its spirit and essential characteristics.

For example, in each of the above embodiments, two heat-use-side spaces (4*b*, 4*b*) are formed in the heat-use-side casing (42). In the present invention, however, three or more heat-use-side spaces (4*b*, 4*b*, . . . ) may be formed in the heat-use-side casing (42). In other words, three or more heat-use-side units (1N, 1N, . . . ) may be provided in the present invention.

Further, in Embodiment 1, two heat-use-side units (1N, 1N) are placed in the same arrangements of components. In the present invention, however, the two heat-use-side units (1N, 1N) may be placed in vertically symmetric arrangements of components with respect to the second parting plate (44) when viewed in FIG. 3. Alternatively, the two heat-use-side units (1N, 1N) may be placed in symmetric arrangements of components with respect to the center point of both the heat-use-side units (1N, 1N). These symmetric arrangements can achieve balanced weight and facilitated installation.

Furthermore, the two delivery ports (46, 46) may be disposed in vertically symmetric positions with respect to the second parting plate (44) or in symmetric positions with respect to the center point of both the heat-use-side units (1N, 1N), when viewed in FIG. 3. In these cases, the port type can be readily discriminated. This prevents misconnection of the delivery duct (71) or the like. In addition, in these cases, the weight can be evenly distributed. This weight distribution can stabilize the position of the air conditioner after installed.

Moreover, the two suction ports (45, 45) and the two open-air intakes (47, 47) may be disposed at the same arrangements with respect to the heat-use-side spaces (4*b*, 4*b*). In this case, specifications in manufacturing can be unified. This facilitates manufacturing process, increases product accuracy and reduces manufacturing costs.

Further, the open-air intake (47) may be formed in only one of the heat-use-side spaces (4*b*).

Furthermore, a single suction duct (70) may be provided for air suction or a single delivery duct (71) may be provided for conditioned air. Namely, either of the suction ports (45) and the delivery ports (46) may be communicated with both the air conditioning zones (2*a*, 2*b*).

As described so far, since the above-mentioned embodiments are illustrative only of the present invention in every respect, it is to be understood that the present invention is not limited to the above embodiments. The scope of the present invention is defined by the claims and is not restricted to this specification. Further, all changes and modifications belonging to the scope equivalent to the scope of the claims are included within the scope of the present invention.

What is claimed is:

1. An air conditioner comprising:

a casing installed on a rooftop, which comprises a heat-use-side casing and a heat-source-side casing which are formed continuously with each other, the heat-use-side casing comprising a plurality of heat-use-side spaces and the heat-source-side casing comprising a heat-source-side space;

a heat-source-side heat exchanger contained in the heat-source-side space;

a plurality of heat-use-side heat exchangers respectively contained in the plurality of heat-use-side spaces;

a plurality of suction ports for air open to the respective heat-use-side spaces and a plurality of delivery ports for conditioned air open to the respective heat-use-side spaces;

a duct which is to communication with a room, the duct being connected with at least one of the suction ports and the delivery ports;

a plurality of heat-use-side fans provided in the plurality of heat-use-side spaces, respectively, the plurality of heat-use-side fans operating in association with the plurality of heat-use-side heat exchangers, respectively; and a refrigerant circuitry formed by connecting the plurality of heat-use-side heat exchangers and the heat-source-side heat exchanger, the refrigerant circuitry comprising a plurality of expansion mechanisms respectively located on liquid lines between branch parts of refrigerant liens and the plurality of heat-use-side heat exchangers, respectively, wherein each of the expansion mechanisms is adjustable in opening in accordance with each heat load, and the plurality of heat-use-side heat exchangers generate conditioned airs different from one another, which are supplied to a plurality of air conditioning zones, respectively.

2. An air conditioner comprising:

a casing installed on a rooftop, which comprises a heat-source-side space and a plurality of heat-use-side spaces;

a heat-source-side heat exchanger contained in the heat-source-side space;

a plurality of heat-use-side heat exchangers respectively contained in the plurality of heat-use-side spaces;

a plurality of suction ports for air open to the respective heat-use-side spaces and an plurality of delivery ports for conditioned air open to the respective heat-use-side spaces;

a duct which is to communicate with a room, the duct being connected with at least one of the suction ports and the delivery ports;

a plurality of heat-use-side fans provided in the plurality of heat-use-side space, respectively, the plurality of heat-use-side fans operating in association with the plurality of heat-use-side exchange respectively; and a refrigerant circuitry formed by connecting the plurality of heat-use-side heat exchangers, and the heat-source-side heat exchanger, the refrigerant circuitry comprising a plurality expansion mechanisms respectively located on liquid lines between branch parts of refrigerant pipes and the plurality of heat-use-side heat exchangers, respectively, wherein each of the expansion mechanisms is adjustable in opening in accordance with each heat load, and the plurality of heat-use-side heat exchangers generate conditioned airs different from one another, which are supplied to a plurality of air conditioning zones, respectively.

3. The air conditioner of claim 1, wherein an open-air intake for taking open air in at least one of the heat-use-side spaces is formed in the casing.

4. The air conditioner of claim 1, wherein heat-recycling heat exchangers for applying heat to dehumidified air are contained individually in the heat-use-side spaces and are connected to the refrigerant circuitry.

5. The air conditioner of claim 1, wherein the refrigerant circuitry is provided with connection ports for connecting an additional heat exchanger thereto.

6. The air conditioner of claim 1, wherein heat-use-side units each containing one of the heat-use-side heat exchangers are contained in the heat-use-side spaces, respectively, and are formed in the same arrangements of components in the respective heat-use-side spaces.

7. The air conditioner of claim 1, wherein heat-use-side units each containing one of the heat-use-side heat exchangers are contained in the heat-use-side spaces, respectively, and the heat-use-side unit in the heat-use-side space of one type and the heat-use-side unit in the heat-use-side space of the other type are formed in symmetric arrangements of components.

8. The air conditioner of claim 1, wherein at least either of the suction ports and the delivery ports are formed at the same positions with respect to the heat-use-side spaces.

9. The air conditioner of claim 1, wherein at least either of the suction ports and the delivery ports are formed so that the port open to the heat-use-side space of one type and the port open to the heat-use-side space of the other type are at symmetric positions.

10. The air conditioner of claim 3, wherein ports of at least one type out of the suction ports, the delivery ports and the open-air intakes are formed at the same positions with respect to the heat-use-side spaces.

11. The air conditioner of claim 3, wherein ports of at least one type out of the suction ports, the delivery ports and the open-air intakes are formed so that the port open to the heat-use-side space of one type and the port open to the heat-use-side space of the other type are at symmetric positions.

12. The air conditioner of claim 2, wherein an open-air intake for taking open air in at least one of the heat-use-side spaces is formed in the casing.

13. The air conditioner of claim 2, wherein heat-recycling heat exchangers for applying heat to dehumidified air are contained individually in the heat-use-side spaces and are connected to the refrigerant circuitry.

14. The air conditioner of claim 2, wherein the refrigerant circuitry is provided with connection ports for connecting an additional heat exchanger thereto.

15. The air conditioner of claim 2, wherein heat-use-side units each containing one of the heat-use-side heat exchangers are contained in the heat-use-side spaces, respectively, and are formed in the same arrangements of components in the respective heat-use-side spaces.

16. The air conditioner of claim 2, wherein heat-use-side units each containing one of the heat-use-side heat exchangers are contained in the heat-use-side spaces, respectively, and the heat-use-side unit in the heat-use-side space of one type and the heat-use-side unit in the heat-use-side space of the other type are formed in symmetric arrangements of components.

17. The air conditioner of claim 2, wherein at least either of the suction ports and the delivery ports are formed at the same positions with respect to the heat-use-side spaces.

18. The air conditioner of claim 2, wherein at least either of the suction ports and the delivery ports are formed so that the port open to the heat-use-side space of one type and the port open to the heat-use-side space of the other type are at symmetric positions.

19. The air conditioner of claim 12, wherein ports of at least one type out of the suction ports, the delivery ports and the open-air intakes are formed at the same positions with respect to the heat-use-side spaces.

20. The air conditioner of claim 12, wherein ports of at least one type out of the suction ports, the delivery ports and the open-air intakes are formed so that the port open to the heat-use-side space of one type and the port open to the heat-use-side space of the other type are at symmetric positions.

* * * * *

UNITED STATES PATENT AND TRADEMARK OFFICE

CERTIFICATE OF CORRECTION

PATENT NO. : 6,272,880 B1
DATED : August 14, 2001
INVENTOR(S) : Hiroshi Miki et al.

It is certified that error appears in the above-identified patent and that said Letters Patent is hereby corrected as shown below:

Column 11, claim 2,
Line 25, please change "space" into -- spaces --; and
Line 27, please change "exchange" into -- exchangers --.

Signed and Sealed this

Sixteenth Day of April, 2002

*Attest:*

*Attesting Officer*

JAMES E. ROGAN
*Director of the United States Patent and Trademark Office*